US005139652A

United States Patent [19]

LeBlanc

[11] Patent Number: 5,139,652

[45] Date of Patent: Aug. 18, 1992

[54] CENTRIFUGAL CLEANER

[75] Inventor: Peter E. LeBlanc, Seminole, Fla.

[73] Assignee: A. Ahlstrom Corporation, Karhula, Finland

[21] Appl. No.: 633,527

[22] Filed: Dec. 31, 1990

[51] Int. Cl.[5] ..... B04C 5/04; B04C 5/081; B04C 5/14

[52] U.S. Cl. ..... 209/211; 210/512.1

[58] Field of Search ..... 209/211; 210/512.1

[56] References Cited

U.S. PATENT DOCUMENTS

| | | | |
|---|---|---|---|
| 2,573,192 | 10/1951 | Fontein | 209/211 X |
| 2,849,930 | 9/1958 | Freeman et al. | 92/28 |
| 3,306,461 | 2/1967 | Weis | 209/211 X |
| 3,391,787 | 7/1968 | Salomon | 210/84 |
| 3,557,956 | 1/1971 | Braun et al. | 210/84 |
| 3,887,456 | 6/1975 | Loughner | 209/211 |
| 3,902,601 | 9/1975 | Townley | 209/211 X |
| 4,148,721 | 4/1979 | Brown et al. | 209/211 |
| 4,175,036 | 11/1979 | Frykhult | 209/211 |
| 4,203,834 | 5/1980 | Martin | 209/211 |
| 4,253,945 | 3/1981 | Karnis | 209/211 |
| 4,334,986 | 6/1982 | Frykhult | 209/17 |

FOREIGN PATENT DOCUMENTS

| | | |
|---|---|---|
| 835739 | 3/1970 | Canada . |
| 773007 | 5/1977 | South Africa . |

*Primary Examiner*—Michael S. Huppert
*Assistant Examiner*—Edward M. Wacyra
*Attorney, Agent, or Firm*—Nixon & Vanderhye P.C.

[57] ABSTRACT

A centrifugal cleaner has a cleaning quotient greater than 0.5 and a rejects by weight performance value typically of less than 5% (e.g. less than 2%) for conventional paper pulp furnish. The tangential inlet nozzle to the side wall near the top of the cleaner body has a non-circular—preferably D-shaped—inlet opening so as to provide enhanced throughput. The cleaner body side wall includes an upper portion that is conical and extends past the top nozzle, a generally cylindrical center portion which significantly increases retention time within the cleaner, and a conical bottom portion in which a bottom nozzle is operatively disposed. The bottom nozzle has a rejects opening therein with a diameter that is about 25–45% (preferbly roughly ⅓) of the internal diameter of the side wall at the opening, and is about 25–45% (preferably roughly ⅓) of the internal diameter of the top nozzle. The bottom nozzle may have an insert with an interior three-dimensional parabolic surface terminating at its bottom in the rejects opening, or may comprise a flat plate with a main top surface perpendicular to the top nozzle. During use rejects particles collect on the flat plate top surface and define a generally parabolic configuration.

22 Claims, 3 Drawing Sheets

FIG. 1
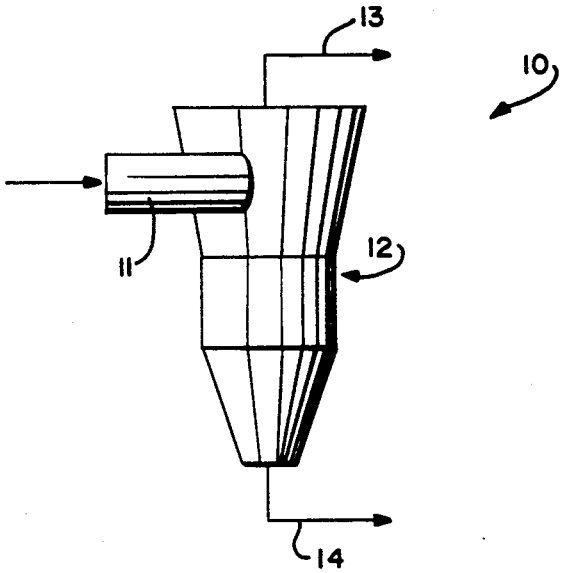
FIG. 2
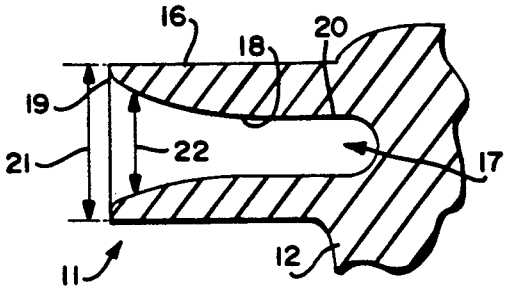
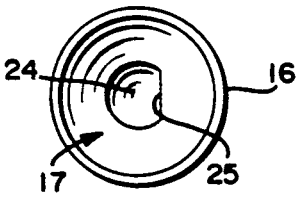
FIG. 3
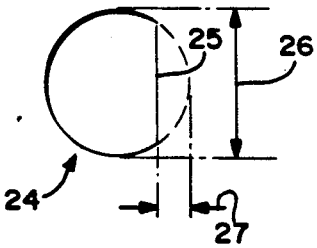
FIG. 4
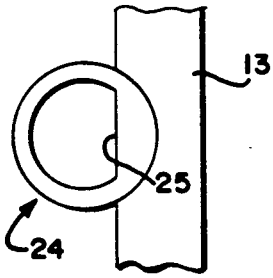
FIG. 5

CENTRIFUGAL CLEANER

BACKGROUND AND SUMMARY OF THE INVENTION

Centrifugal cleaners have been known for decades. In a typical use of a centrifugal cleaner it is desirable to remove as many contaminants (rejects, debris) as possible while removing as little desirable material (accepts) as possible. Many different structures and implementation schemes have been designed to accomplish this desirable end result, however conventional cleaners still are not as effective as desired for many applications. For example in the separation of contaminants—such as pieces of plastic, particularly particles having a size of less than 0.5 $mm^2$—from conventional paper pulp furnish, even when four stages of centrifugal cleaner are utilized the effectiveness of contaminants removal is less than desired, and too much fiber is lost in the rejects stream.

According to the present invention, three distinct—but readily combinable—improvements are provided to conventional centrifugal cleaners which remarkably improve their effectiveness. Virtually all centrifugal cleaners have a generally hollow main body with a side wall having a generally decreasing conical taper from the top toward the bottom, a tangential inlet nozzle in the side wall near the body top for introducing fluid material to be cleaned, a top outlet nozzle extending downwardly into the body through the top and centrally located in the body, the bottom of the top nozzle located below the tangential inlet nozzle, and a bottom nozzle disposed in the side wall and generally concentric with the top outlet nozzle, and spaced from the tangential inlet nozzle. The improvements according to the invention relate to the configuration of the tangential inlet nozzle, the provision of a cylindrical section of the body in the side wall between conical upper and lower portions, and the particular construction of the bottom nozzle to define a particular rejects opening.

A typical tangential inlet nozzle is circular in configuration. It has been found according to the present invention that a circular configuration is far from ideal, causing turbulence and flow patterns which interfere significantly with the vortex action desirably introduced into the fluid by the tangential inlet. According to the present invention, a non-circular opening of smaller cross dimension than is typically utilized is provided. The inlet opening has no portion thereof which intersects the top nozzle—that is an extension from the straight leg of the D is substantially coincident with the exterior surface of the top nozzle. With such a configuration, for the same pressure drop there is higher velocity (and therefore better cleaning action) and increased throughput. A better free vortex is provided at the top of the cleaner, and since the type of turbulence and complicated flows typically ensuing when the flow of introduced fluid impacts the top nozzle is eliminated, the throughput is increased on the order of about 25%.

The second improvement according to the present invention is the provision of an interior section of the cleaner body which increases retention time. When retention time is increased, the time for the particles to "settle" is also increased, and thus the removal efficiency. According to the present invention, the body side wall of the cleaner comprises an upper portion that is conical and extends past the bottom of the top nozzle, and a conical bottom portion of the side wall which is disposed in operative association with the bottom nozzle. Between them is a means for increasing retention time within the cleaner, comprising a generally cylindrical center portion of the side wall.

The third improvement according to the invention is the most significant from the operational standpoint. By providing a particular design of bottom nozzle according to the present invention it is possible to eliminate multiple stages of multiple stage cleaners, to maximize the accepts portion, and minimize the rejects portion discharged from the cleaner, while effectively removing contaminants. The cleaner according to the present invention is particularly effective with contaminant particles having a size of less than about 0.5 $mm^2$. The cleaner according to the present invention has a cleaning quotient greater than 0.5, and a rejects by weight performance of less than 5%, for conventional paper pulp furnish, remarkable advances compared to prior art cleaners not utilizing the invention.

The bottom nozzle according to the invention includes means for defining a rejects opening having a diameter that is about 25–45% of the internal diameter of the top outlet nozzle, e.g. roughly ⅓ (about 37%) of the internal diameter of the top outlet nozzle. Preferably it has a diameter that is about 25–45% of the internal diameter of the side wall at the rejects opening too, again typically roughly ⅓ the internal diameter of the side wall at the rejects opening.

The rejects opening is best formed in one of two ways. In the first embodiment the means defining the rejects opening comprises a substantially flat plate having a main top surface generally perpendicular to the top nozzle, and having an exterior diameter equal to the interior diameter of the side wall at that point along the body. In this embodiment rejects particles build up in about one or two minutes of operation to form an internal three dimensional parabolic surface tapering down to the rejects opening. According to a second embodiment of the invention, an insert is provided that already has the three dimensional parabolic configuration so that actual discharge of rejects begins almost immediately upon starting operation of the cleaner.

It is the primary object of the present invention to provide a centrifugal cleaner with enhanced effectiveness. This and other objects of the invention will become clear from an inspection of the detailed description of the invention and from the appended claims.

BRIEF DESCRIPTION OF THE DRAWINGS

FIG. 1 is a side schematic view of an exemplary centrifugal cleaner according to the invention;

FIG. 2 is a cross-sectional view of the tangential inlet nozzle of the cleaner of FIG. 1;

FIG. 3 is an end view of the inlet nozzle of FIG. 2;

FIG. 4 is a detail view of the "D" shaped inlet opening of the nozzle of FIGS. 2 and 3;

FIG. 5 is a schematic representation showing the relationship between the inlet nozzle of FIGS. 3 and 4 and the top nozzle of the cleaner of FIG. 1;

DETAILED DESCRIPTION OF THE DRAWINGS

Figure 6:
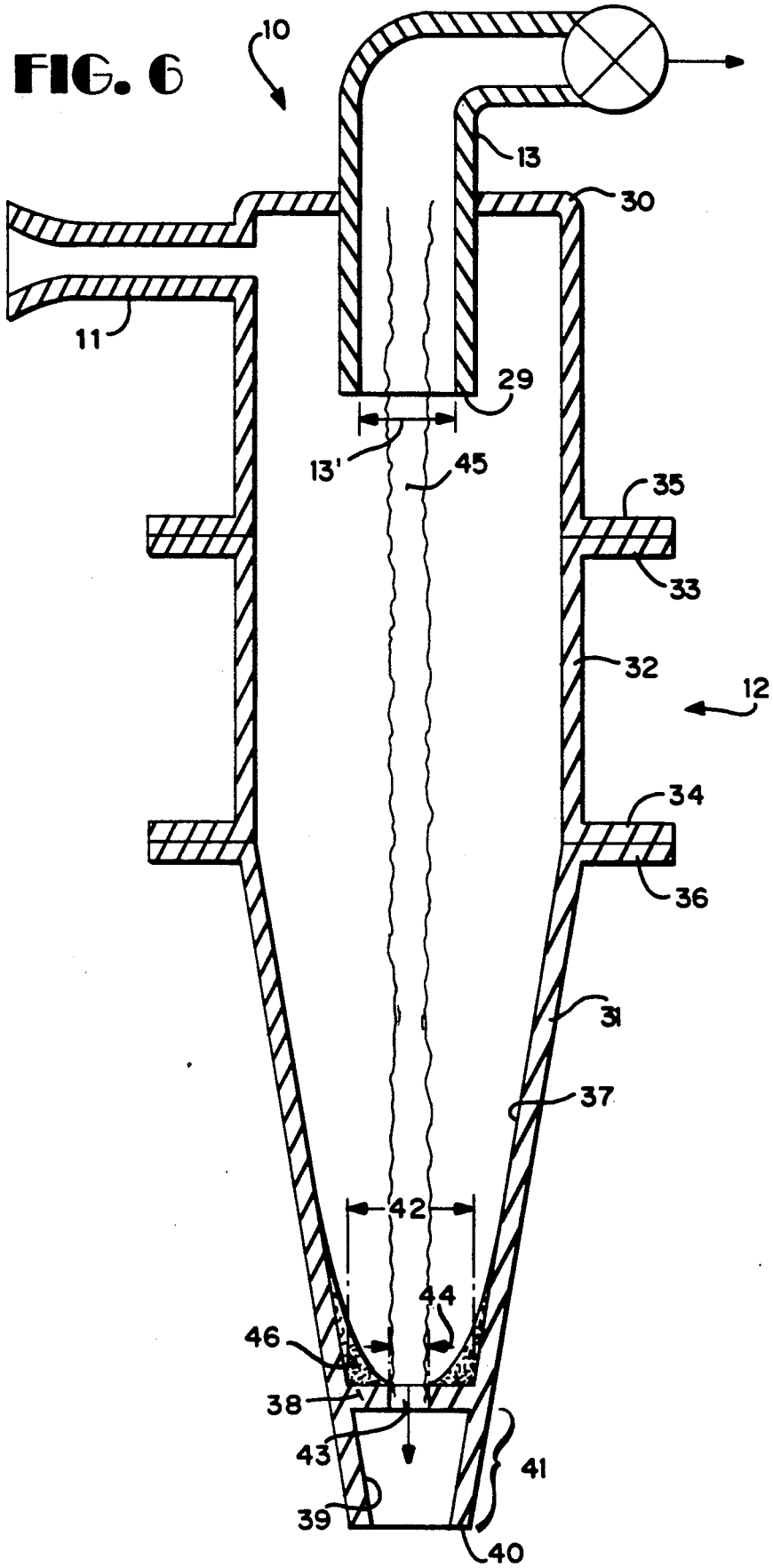
FIG. 6 is a schematic cross-sectional view of the cleaner of FIG. 1.

An exemplary centrifugal cleaner according to the invention is shown generally by reference numeral 10 in FIGS. 1 and 6. Major components include the tangential inlet nozzle 11 to a generally hollow main body 12, an accepts outlet defined by a top outlet nozzle 13, and a rejects outlet 14 from the bottom of the cleaner 10. Those elements, per se, are known in the art, however the particular configuration of the tangential inlet nozzle 11, the side wall of the body 12, and a bottom nozzle adjacent the bottom of the body 12, are different according to the invention.

The tangential inlet nozzle 11—as seen most clearly in FIGS. 2 through 5—is defined by a pipe 16 having an interior 17 defined by a tapered wall 18 from the end 19 most remote from the body 12, to an end 20 closest to the body 12. Typically, the external diameter 21 of the tube 16 at the end 19 is about 1.6 inches, while the internal diameter 22 just to the right thereof (see FIG. 2) is about 1.5 inches. The wall 18 tapers down to a non-circular inlet opening 24 which has as its largest diameter (cross-sectional dimension) about 0.91 inches. This is smaller than the conventional design which has an external diameter of the pipe of about 1.6 inches but a generally constant diameter internal passageway of about 1.05 inches, terminating in a circular inlet opening with that same (about 1.05 inch) internal diameter.

Preferably the non-circular configuration of the inlet opening 24 approximates a D-shape, having a straight leg 25 portion "cutting off" what would otherwise be a circular opening. As earlier indicated, the largest cross dimension 26 (see FIG. 4) of the opening 24 is about 0.91 inches in a preferred embodiment, while the perpendicular "cut off" distance 27 is about 0.18 inches.

As seen n FIG. 5, the D shape of the opening 24 is designed so that no portion thereof intersects the top nozzle 13. As can be seen in FIG. 5, an extension from the straight leg 25 of the D is substantially coincident with the exterior surface of the top nozzle 13.

The configuration of the inlet opening 24, and the rest of the nozzle 11, as described above results in an increase in throughput of about 25% compared to the conventional design of nozzle having a circular inlet opening of about 1.05 inches, while it has substantially the same pressure drop, and therefore provides a higher velocity (a better free vortex at the top of the cleaner), so that better cleaning action can occur. Thus—unexpectedly—a decrease in the size of the inlet opening 24, and a change in the shape thereof, reduces the resistance of the flow of fluent material into the cleaner, and thereby significantly increases throughput.

The second improvement according to the present invention—which is independent of the inlet nozzle design 11 as described above—comprises a particular construction of the side wall 12. As illustrated most clearly in FIG. 6, the cleaner body side wall comprises an upper portion 30 that is at least slightly conical, tapering gradually inwardly as it moves downwardly from the top toward the bottom of the cleaner, with the flange 35 thereof extending past the bottom 29 of the circular top outlet nozzle 13. At the bottom of the cleaner 10 is a conical bottom portion 31 which also tapers inwardly from the top toward the bottom thereof, and has an upper flange 36. According to the invention, means are provided for increasing the retention time of particles within the cleaner, so as to enhance settling and thereby removal efficiency. Such retention time increasing means comprises the generally cylindrical (constant internal diameter) center portion 32 of the side wall 12, having upper and lower flanges 33, 34 which respectively cooperate with the flanges 35, 36 of the upper and lower portions 30, 31 of the cleaner.

The third improvement according to the present invention—which is independent of both of the above structures, but of course may be utilized therewith to provide the most effective cleaner—includes the particular construction of the bottom nozzle disposed within the side wall 12 and spaced from the top outlet nozzle 13 and tangential inlet nozzle 11. The bottom nozzle is disposed in operative association with the inner tapering wall 37 of the side wall section 31.

In the preferred embodiment of the bottom nozzle construction according to the invention as illustrated in FIG. 6, a plate 38 is provided. Below the plate 38 the interior of the cleaner side wall continues to taper inwardly, as indicated at 39, and the cleaner terminates at a bottom lip 40, providing an extension 41 below the plate 38. The plate 38 has an exterior diameter 42 which is for all practical purposes equal to the internal diameter of the sloping inner wall 37 at the point along the portion 31 of the side wall 12 at which the plate is provided. The plate 38 has an upper surface which is substantially perpendicular to the top outlet nozzle 13, and is substantially flat. The plate defines a rejects opening 43 therein. The rejects opening 43 has a diameter 44. The diameter 44 is essentially equal to the diameter of the air core (inner vortex) 45 of the cleaner 10.

According to the present invention, the particular dimensional relationship between the diameter 44 and other components is important. Typically, the diameter 44 of the opening 43 is between about 25–45% of the internal diameter of the top outlet nozzle 13. Preferably it is roughly about ⅓ that diameter, for example in one embodiment it is about 37%. Also, typically the plate 38 is constructed so that the outer diameter 42 thereof is approximately equal to the internal diameter of the nozzle 13; that is, the diameter 44 is about 25–45% (e.g. roughly one-third) of the diameter 42, so that the area of the plate 38 outside of the centrally located rejects opening 43 therein is greater than the area of the opening 43.

In one typical construction according to the present invention, the rejects opening 43 has a diameter of about 11 mm., while the diameter 42 is about 30 mm., and the internal diameter 13' of the top outlet 13 is about 30 mm.

When the cleaner 10 illustrated in FIG. 6 is utilized, the first one or two minutes of operation debris is not discharged through the bottom 40 of the cleaner 10, but rather it builds up on top of the upper surface of the plate 38. Debris particles build up in a substantially three dimensioned parabolic configuration 46 which terminates at the bottom thereof in the rejects opening 43. Once that configuration 46 of particles is established, then debris is discharged into the rejects line 14.

Figure 7:
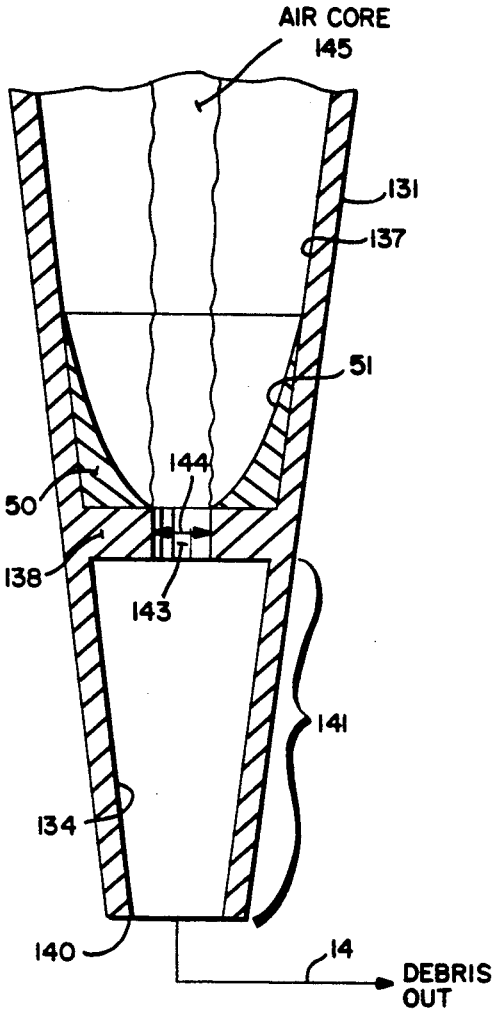
FIG. 7 is a detail cross-sectional view of an alternative configuration of the bottom nozzle of an exemplary cleaner according to the invention.

An alternative embodiment of the bottom nozzle is illustrated in FIG. 7. In this embodiment, structures comparable to those in the FIG. 6 embodiment are shown by the same reference numeral only preceded by a "1". In this embodiment, on top of the plate 38—or integral therewith—is provided an insert 50 having an interior sloping wall 51. The configuration of the wall 51 is a simulation of a three dimensional parabola, which terminates at the bottom thereof in the rejects opening 143.

In both embodiments described above, the thickness of the plate 38, 138 is not particularly significant. The thickness does not really relate to the removal functions, but it is desirable that the plate have a substantial thickness just so that it does not wear out quickly. A thickness of about one-half inch for the plate 38 is practical.

Actual tests have been done on a number of different types of conventional cleaners having the bottom nozzle configuration as illustrated in FIG. 6. In such trials, the particular inlet 11 and the particular cylindrical body section 32 described above and illustrated in FIG. 6 were not utilized; rather the "flat bottom" configuration of the tip of the cleaner (bottom nozzle) described above was the only change made to the conventional cleaner. From such testing it was clearly demonstrated that the bottom nozzle configuration according to the invention improves the debris removal effectiveness of the cleaner. Improvements were most significant as the particle size decreased, and were dramatically effective where the debris particles had a size of less than 0.5 $mm^2$. The pressure drop required to process 150 gpm through the cleaner increased slightly when the cleaner according to the invention was utilized, but the accept tonnage was significantly greater at comparable feed tonnages. Consequently, to get the same amount of clean, usable fiber a lower feed flow rate is provided.

Table I below illustrates the actual test results for a conventional cleaner having two different designs of conventional bottom nozzles, and the bottom nozzle according to the invention. The conventional cleaner of Table I is a Bauer 606 Top Inlet Cleaner. The cleaner included its typical size top outlet nozzle, and was essentially unmodified except for the bottom nozzle. The cleaner was attached to a laboratory DECULATOR and was run under boiling point vacuum. The fluent material used for the cleaning operation was bleached softwood kraft paper pulp having a consistency of about 0.80%. The debris particles—which were standardized and introduced into the system for removal—were polyvinyl chloride grindings that ranged in area from 0.009 $mm^2$ to 1 $mm^2$. The specific gravity was measured to be 1.4. Trials A through C in Table I compare a one inch diameter standard tip (bottom nozzle), a ⅞ inch diameter standard tip, and a 0.94 inch diameter (the size of the rejects opening 43) tip according to the invention, respectively.

TABLE I

BAUER 606 TOP INLET CLEANER
REJECT TIP COMPARISONS

| Trial | Flow (gpm) | Const | Tons/ Day | P(psid) | CSF |
|---|---|---|---|---|---|
| A | Feed: 150 | .87 | 7.8 | 25.7 | 675 Qavg: .0151 |
| | Acct: 127 | .74 | 5.6 | | 712 RWT: 19.4% |
| | Rejt: 23.0 | 1.10 | 1.5 | | 710 EFF: 25.1% |
| B | Feed: 150 | .79 | 7.1 | 27.2 | 715 Qavg: .3376 |
| | Acct: 135 | .65 | 5.3 | | 691 RWT: 21.7% |
| | Rejt: 14.8 | 1.74 | 1.5 | | 726 EFF: 35.8% |
| C | Feed: 150 | .79 | 7.1 | 28.8 | 656 Qavg: .5459 |
| | Acct: 149 | .82 | 7.4 | | 667 RWT: 1.6% |
| | Rejt: 0.95 | 1.98 | .11 | | 692 EFF: 9.5% |

TRIAL A: 1.0" DIA STANDARD TIP
TRIAL B: ⅞" DIA STANDARD TIP
TRIAL C: .94" DIA TIP ACCORDING TO INVENTION

Analyzing the results of Table I it will be seen that the cleaning quotient ("Qavg") for the cleaner according to the invention is enormously greater than the same quality for the conventional tip configurations. [Qavg, or cleaning quotient, is equal to the debris in the rejects minus the debris in the accepts, together divided by the debris in the rejects.] Similarly the rejects by weight ("RWT") performance value is dramatically less.

Figure 8:
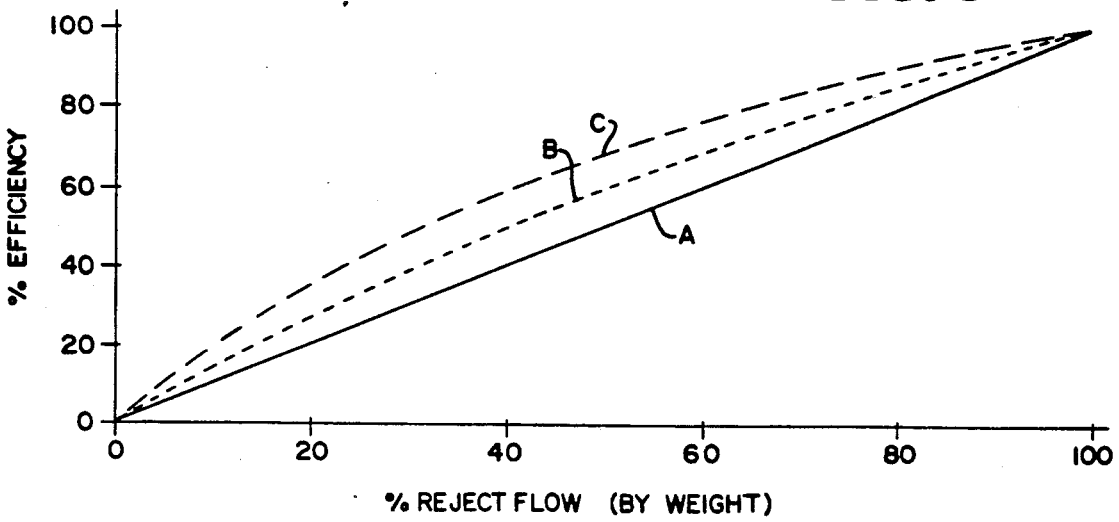
FIG. 8 is a graph comparing efficiency as a function of reject flow (by weight) of a cleaner according to the invention compared to identical prior art cleaners without the invention.

It should be noted that the efficiency ("EFF") calculation in Table I is misleading as far as the effectiveness of the units is concerned. The equation used to calculate the particular efficiency value in Table I is very dependent on reject rate, and is misleading as to actual efficiencies. FIG. 8, on the other hand, plots percentage efficiency as a function of reject flow (by weight) for the trials of Table I, and indicates the superior performance of the cleaner (plot C) according to the invention.

In a typical operation of a cleaner 10 as illustrated in FIG. 6, the material to be treated (e.g. paper pulp furnish having a consistency of about 0.5–1.5%) is introduced into inlet 11 so that a free vortex forms in the top of the body 12. The D-shape configuration of the inlet opening 24 maximizes throughput. As the pulp suspension spins downwardly in a vortex within the body 12, its retention time is significantly increased by the cylindrical section 32. Ultimately the downwardly spiralling vortex of pulp suspension impacts the plate 38, while an inner vortex or air core 45 extends upwardly therefrom to the accepts outlet 13. Particles (46) which have been separated out by the centrifugal action of the cleaner 10 collect on the top of the plate 38 and form a generally three dimensional parabolic surface. After about one or two minutes of operation the surface of particles 46 is formed, and then debris particles—of very high consistency—are discharged from the bottom 40 of the cleaner 10 into the debris line 14. Meanwhile, the accepts flow through the top nozzle 13 is maximized.

In this specification, and the following claims, the reference to "top", "bottom", and the like to describe the positions of the components is for reference and description purposes only, and does not imply an actual orientation with respect to vertical. That is the cleaner 10 will also operate with the debris outlet 40 vertically above and in line with the accepts outlet 13, and all orientations therebetween.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A centrifugal cleaner comprising:

a generally hollow main body having a top and a bottom, and a side wall having at least a portion thereof having a generally decreasing conical taper from the top toward the bottom of the body, and having an internal diameter;

a tangential inlet nozzle in said side wall near said body top for introducing fluid material to be cleaned;

a top outlet nozzle extending downwardly into said body through said top and centrally located in said body, the bottom of said top nozzle located below said tangential inlet nozzle, said top nozzle having an internal diameter;

a bottom nozzle disposed in said side wall decreasing conical taper portion and spaced from and generally concentric with said top outlet nozzle, and spaced from said tangential inlet nozzle; and said bottom nozzle including means for defining a rejects opening therein having a constant diameter that is about 25–45% of the internal diameter of said side wall at said opening, and is about 25–45% of the internal diameter of said top outlet nozzle.

2. A cleaner as recited in claim 1 wherein said bottom nozzle includes means defining a rejects opening that is roughly one third the internal diameter of said top outlet nozzle.

3. A cleaner as recited in claim 2 wherein said bottom nozzle includes means defining a rejects opening that is about 37% the internal diameter of said top outlet nozzle.

4. A cleaner as recited in claim 1 wherein said bottom nozzle means defining a rejects opening comprises a substantially flat plate of rigid material having a main surface generally perpendicular to said top nozzle, and having an exterior diameter equal to the interior diameter of said side wall at that point along said body.

5. A cleaner as recited in claim 4 wherein said plate has an outer diameter of roughly 30 mm, and said opening therein has a diameter of roughly 11 mm, and said top outlet nozzle has an internal diameter of roughly 30 mm.

6. A cleaner as recited in claim 4 wherein said bottom nozzle includes means defining a rejects opening that is about 37% the internal diameter of said top outlet nozzle.

7. A cleaner as recited in claim 1 wherein said bottom nozzle means defining a rejects opening comprises an insert having an interior three dimensional parabolic surface terminating at the bottom thereof in said rejects opening.

8. A cleaner as recited in claim 1 wherein said inlet nozzle includes means defining a non-circular inlet opening that has no portion thereof which intersects said top nozzle, so as to provide enhanced throughput.

9. A cleaner as recited in claim 8 wherein said inlet nozzle opening has a substantially "D" shape, an extension from the straight leg of the D being substantially coincident with an exterior surface of said top nozzle.

10. A cleaner as recited in claim 9 wherein said body side wall comprises: an upper portion that is conical and extends past the bottom of said top nozzle; means for significantly increasing retention time within said cleaner, comprising a generally cylindrical center portion of said side wall; and a conical bottom portion of said side wall, said bottom nozzle disposed in operative association with said bottom portion.

11. A cleaner as recited in claim 1 wherein said body side wall comprises: an upper portion that is conical and extends past the bottom of said top nozzle; means for significantly increasing retention time within said cleaner, comprising a generally cylindrical center portion of said side wall; and a conical bottom portion of said side wall, said bottom nozzle disposed in operative association with said bottom portion.

12. A centrifugal cleaner comprising:

a generally hollow main body having a top and a bottom, and a side wall having at least a portion thereof having a generally decreasing conical taper from the top toward the bottom of the body, and having an internal diameter;

a tangential inlet nozzle in said side wall near said body top for introducing fluid material to be cleaned;

a top outlet nozzle extending downwardly into said body through said top and centrally located in said body, the bottom of said top nozzle located below said tangential inlet nozzle, said top nozzle having an internal diameter;

a bottom nozzle disposed in said side wall decreasing conical taper portion and spaced from and generally concentric with said top outlet nozzle, and spaced from said tangential inlet nozzle; and said bottom nozzle including means for defining a rejects opening therein of constant diameter, said means comprising a rigid material plate having a substantially flat upper surface generally perpendicular to said top nozzle, said plate upper surface having a solid area greater than the area of said rejects opening therein.

13. A cleaner as recited in claim 12 wherein said rejects opening is roughly about one third the diameter of the internal diameter of said top nozzle.

14. A cleaner as recited in claim 12 wherein said inlet nozzle includes means defining a non-circular inlet opening that has no portion thereof which intersects said top nozzle, so as to provide enhanced throughput.

15. A cleaner as recited in claim 14 wherein said inlet nozzle opening has a substantially "D" shape, an extension from the straight leg of the D being substantially coincident with an exterior surface of said top nozzle.

16. A cleaner as recited in claim 15 wherein said body side wall comprises: an upper portion that is conical and extends past the bottom of said top nozzle; means for significantly increasing retention time within said cleaner, comprising a generally cylindrical center portion of said side wall; and a conical bottom portion of said side wall, said bottom nozzle disposed in operative association with said bottom portion.

17. A cleaner as recited in claim 12 wherein said body side wall comprises: an upper portion that is conical and extends past the bottom of said top nozzle; means for significantly increasing retention time within said cleaner, comprising a generally cylindrical center portion of said side wall; and a conical bottom portion of said side wall, said bottom nozzle disposed in operative association with said bottom portion.

18. A centrifugal cleaner comprising:

a generally hollow main body having a top and a bottom, and a side wall having at least a portion thereof having a generally decreasing conical taper from the top toward the bottom of the body, and having an internal diameter;

a tangential inlet nozzle in said side wall near said body top for introducing fluid material to be cleaned;

a top outlet nozzle extending downwardly into said body through said top and centrally located in said body, the bottom of said top nozzle located below said tangential inlet nozzle, said top nozzle having an internal diameter;

a bottom nozzle disposed in said side wall decreasing conical taper portion and spaced from and generally concentric with said top outlet nozzle, and spaced from said tangential inlet nozzle; and said bottom nozzle including means for defining a rejects opening therein of constant diameter, said means comprising an insert having a three dimensional parabola configuration having inner walls sloping downwardly to the central rejects opening.

19. A cleaner as recited in claim 18 wherein said rejects opening is roughly about one third the diameter of the internal diameter of said top nozzle.

20. A centrifugal cleaner comprising:

a generally hollow main body having a top and a bottom, and a side wall having at least a portion thereof having a generally decreasing conical taper from the top toward the bottom of the body, and having an internal diameter;

a tangential inlet nozzle in said side wall near said body top for introducing fluid material to be cleaned;

a top outlet nozzle extending downwardly into said body through said top and centrally located in said body, the bottom of said top nozzle located below said tangential inlet nozzle, said top nozzle having an internal diameter;

a bottom nozzle disposed in said side wall decreasing conical taper portion and spaced from and generally concentric with said top outlet nozzle, and spaced from said tangential inlet nozzle;

wherein the inlet nozzle includes means defining a non-circular inlet opening that has no portion thereof which intersects said top nozzle, so as to provide enhanced throughput; and wherein said inlet nozzle opening has a substantially "D" shape, an extension from the straight leg of the D being substantially coincident with an exterior surface of said top nozzle.

21. A cleaner as recited in claim 20 wherein said body side wall comprises: an upper portion that is conical and extends past the bottom of said top nozzle; means for significantly increasing retention time within said cleaner comprising a generally cylindrical center portion of said side wall; and a conical bottom portion of said side wall, said bottom nozzle disposed in operative association with said bottom portion.

22. A centrifugal cleaner comprising:

a generally hollow main body having a top and a bottom, and a side wall having at least a portion thereof having a generally decreasing conical taper from the top toward the bottom of the body, and having an internal diameter;

a tangential inlet nozzle in said side wall near said body top for introducing fluid material to be cleaned;

a top outlet nozzle extending downwardly into said body through said top and centrally located in said body, the bottom of said top nozzle located below said tangential inlet nozzle, said top nozzle having an internal diameter;

a bottom nozzle disposed in said side wall decreasing conical taper portion and spaced from and generally concentric with said top outlet nozzle, and spaced from said tangential inlet nozzle; and wherein said body side wall comprises: an upper portion that is conical and extends past the bottom of said top nozzle; means for significantly increasing retention time within said cleaner, comprising a generally cylindrical center portion of said side wall; and a conical bottom portion of said side wall, said bottom nozzle disposed in operative association with said bottom portion.

* * * * *